United States Patent [19]

Langerock

[11] 4,020,899

[45] May 3, 1977

[54] ATMOSPHERIC COOLING TOWER WITH DRY-TYPE HEAT EXCHANGERS

[75] Inventor: Luc Felix Marie-Louis Ghislain Langerock, Brussels, Belgium

[73] Assignee: Hamon-Sobelco S.A., Belgium

[22] Filed: May 6, 1975

[21] Appl. No.: 575,029

[30] Foreign Application Priority Data

Nov. 27, 1974 Luxembourg ..... 71376

[52] U.S. Cl. ..... 165/110; 60/693; 165/DIG. 1; 165/125

[51] Int. Cl.[2] ..... F28B 1/02

[58] Field of Search ..... 165/DIG. 1, 110, 111, 165/125; 60/690, 692, 693

[56] References Cited

UNITED STATES PATENTS

| | | | |
|---|---|---|---|
| 3,434,529 | 3/1969 | Daltry | 165/47 |
| 3,519,068 | 7/1970 | Harris et al. | 165/DIG. 1 |
| 3,844,344 | 10/1974 | Kliemann et al. | 165/110 |

FOREIGN PATENTS OR APPLICATIONS

| | | | |
|---|---|---|---|
| 1,960,619 | 1/1972 | Germany | 165/DIG. 1 |
| 711,216 | 1971 | South Africa | 165/DIG. 1 |

*Primary Examiner*—Albert W. Davis, Jr.
*Attorney, Agent, or Firm*—Harold L. Stowell

[57] ABSTRACT

An air cooled dry-type cooling tower having two sets of dry type heat exchange assemblies with the first set mounted in a vertically extending array on a circle concentric to the wall of the tower housing and the second set mounted generally horizontal and extending from the first set to the wall of the tower housing.

8 Claims, 8 Drawing Figures

ATMOSPHERIC COOLING TOWER WITH DRY-TYPE HEAT EXCHANGERS

CROSS-REFERENCE TO RELATED APPLICATIONS

This application is based on and claims the priority of Luxembourg application 71,376 filed Nov. 27, 1974.

BACKGROUND OF THE INVENTION

1. Field of the Invention

The invention is directed to a circular cooling tower with heat exchangers of the dry-type, operating by natural draft and achieving the exchange of heat between two fluids such as atmopsheric air, ordinarily, and another fluid, generally water.

2. Description of the Prior Art

Heat exchangers for cooling towers are generally rectangular units (parallelipipedic) of smooth or finned tube batteries joined at their extremities by fluid-feed boxes, and the fluid which circulates from one box to the other being cooled by the cold air which crosses the interstices between the tubes. The material of the metal or plastic tubes is selected in accordance with the nature of the warm fluid to be cooled; the air emitted by the tower is generally hot and dry, e.g., air at 40° C with 15% relative humidity.

Such cooling towers, in the form of a chimney and, having at their base, an air intake entry, surmounted by the lintel of the tower serving as a seating for the chimney, are generally for the purpose of cooling a fluid, generally the water from steam-turbine condensers of electrical power plants, or for condensing directly the water vapor originating from the turbines and cooling the hot condensate. The electrical power produced is related with the cooling power of the tower; that is, among other things, to the total length of tubes of the exchangers, but the efficiency of the exchange of heat depends also on the uniformity of passage of the air through the heat exchangers.

The establishment and maintenance of optimum conditions pose thorny problems with regard to the dimensions of the tower, the arrangement of the batteries and the means to provide for minimizing the harmful effects of the wind on the heat exchangers.

Since the cold air surrounding the tower enters the tower horizontally through the air intake opening and escapes vertically through the chimney, two distinct mountings of the exchange surface can be designed. In accordance with the first, the units are placed in the opening itself with their tubes erected vertically; according to the other, the units are placed across a section of the chimney, at its base, with their tubes aligned substantially horizontally.

The principal advantage of vertical-battery towers, resides in the simplicity of the mounting. On the other hand, such towers are extremely sensitive to variations in the speed and direction of the wind, since the units exposed to the wind are cooled more than those which are located out of the wind and there are sometimes local observations of inversions in the direction of the air flow through the tower. It also happens, during a storm, that the air passes right through the units on the periphery of the tower. It is quite obvious that the local and overall fluctuations in the cool air current crossing the tower and emitted by the chimney cause cooling irregularities for the water and are inevitably translated by changes in electrical power output. It is also clear that these fluctuations cannot be totally prevented, even if the wind is constantly moderate.

It has been proposed to minimize the effect of the wind by placing, in front of the openings, at the base of the tower mobile panels adjustable according to the direction and intensity of the wind. Such means makes it possible to improve the overall yield of the tower, but the cost of installing the panels and, especially, of their operation takes a heavy toll on the expense of the electrical plant.

The second type of mounting which can be designed for the dry surface of heat exchange units consists in equipping the section of the chimney situated just above the air intake opening with horizontal or slightly inclined batteries or units aligned for the most part radially or concentrically in relation to the periphery of the chimney.

In such towers it is known that the amount of cold air entering into contact with the exchangers is different at different distances from the center, so that the exchange of heat is irregular and its yield less satisfactory. Such an arrangement of exchangers, then, does not produce the best overall exchange of heat, even if the wind effect is not considered; while the cooling yield worsens when the wind blows.

It has been suggested that the cold air flow profile could be improved by directing the air along directing surfaces (air deflectors) having low resistance to the passage of the air, and which are distributed over the entire section of the tower, but this method is quite costly.

It is also known to compensate for the harmful effects by reducing the height to which the cold air is brought to the batteries located in the center of the tower, i.e., by placing ceter units at a lower level than the peripheral units, but this arrangement makes the central units much more sensitive to the effect of the wind.

A prior art answer to this last mentioned disadvantage was proposed and comprises in placing the central units higher than the peripheral units, which results in reducing the draft height of the chimney.

Lastly, a prior art compromise between the various previous proposals, consists in mounting the units in hog-back fashion with separating partitions in order to use them as air-guides, in aligning them progressively and radially downwards from the periphery towards the center of the tower, and in imparting to the units a height which progressively decreases toward the center in order to regularize the cold air flow profile without compromising the draft of the chimney.

It is likely that the arrangement recommended does indeed improve the overall yield of the tower but the use of units which have different dimensions, calculated according to the position which they are supposed to occupy in the tower, and which are provided with separating partitions for the purpose of blocking the wind, will of necessity increase the cost of the installation. In addition, with both types of arrangements of units as mentioned above, it would appear that the cooling power can only be increased by increasing the diameter of the tower, which in turn increases the cost of construction.

OBJECTS OF THE INVENTION

It is therefore a primary object of this invention to provide a mounting arrangement for dry heat exchange units such that cooling capacity of the tower is very efficient and uniform and so that the air flow is practically unaffected by fluctuations of wind and better sheltered from gusts of wind inside the tower in case of storm.

SUMMARY OF THE INVENTION

These and other goals are provided by an air cooled circular dry-type cooling tower assembly comprising a tower open at the upper end for the discharge of heated air, a peripheral air inlet about the base of the tower and a plurality of dry-type heat exchange assemblies mounted in said tower characterized in that the heat exchange assemblies comprises a first set of heat exchange units mounted within the tower in a vertically extending array on a circle concentric to the periphery of the tower, and a second set of heat exchange units mounted in a generally horizontal plane and extending in the annular air passage between from the tops of said first set of heat exchange units and the wall of the tower.

The vertical panels of tubes may be arranged so as to form flat batteries or units, the vertical exchange surface describing in this case in straight section, a convex polygon. Alternatively, the vertical panels of tubes can be assembled so as to form batteries in the shape of a V, the vertical exchange surface describing then in a straight section a concave or toothed polygon. Following this latter assembly method, the point of the V-shaped battery couples is directed either towards the inside of the tower, or towards the outside.

In accordance with the invention, the batteries situated radially above the air entry have their tubes arranged horizontally or in a slightly inclined manner on the horizontal, in order to facilitate emptying the tubes or to allow the use of tubes with standardized dimensions or to provide a better arrangement of the tower as a whole. These radial batteries are arranged either in the same alignment (tubes parallel to each other, on the same levels), or grouped in twos in the form of roofs, the peaks of which are directed upwards, or grouped in twos in the shape of a V, the apex of which is directed downwards.

In contrast to known towers in which the hot fluid circulates in a single battery-unit, the two units of batteries according to the invention may be connected for internal fluid-feeding, in series between each battery of a unit, and the corresponding battery of the other unit, with collectors of hot fluid and of cooled fluid being advantageously placed at the bottom of the vertical batteries.

Alternately, both battery units may be connected in parallel for internal fluid feeding; the collectors may be placed between the two units, or may be divided into two and placed at the bottom of the vertical batteries and at the level of the lintel of the tower, or there may be a common collector located between the two units and a collector for each unit, one placed on the bottom of the vertical batteries and the other at the lintel.

The batteries are advantageously erected in a zone between one fifth and about one third of the radius of the tower from the periphery.

The tower has wind screens analogous to those provided inside so-called wet circular cooling towers, to stop very strong winds, and which consist of vertical, flat walls erected radially on the ground from the periphery either to the end point of the batteries, or to an intermediate point between the extremity of the vertical batteries and the center of the tower.

The natural draft of the chimney may be aided either by ventilators blowing atmospheric air across the exchangers, or by ventilators sucking atmospheric air across exchangers and which are installed inside the chimney, for the purpose, in particular, of avoiding direct sound radiation of the ventilators in the vicinity of the cooler.

BRIEF DESCRIPTION OF THE DRAWING

The invention will be more fully described in reference to the drawing wherein.

DESCRIPTION OF THE PREFERRED EMBODIMENTS

Figure 1:
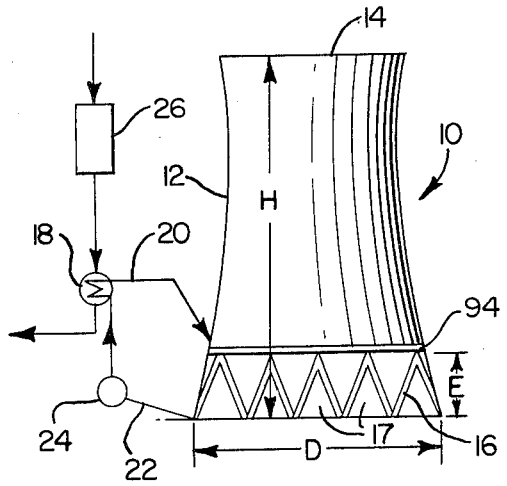
FIG. 1 is a diagrammatic elevational view of a chimney type cooling tower suitable for carrying out the present invention.
Figure 2:
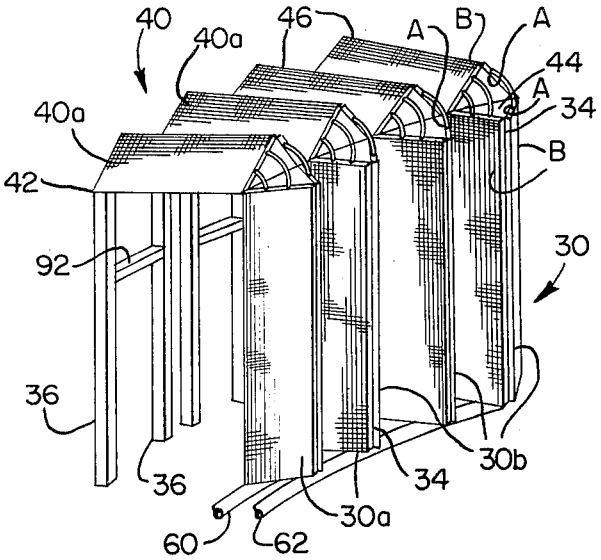
FIG. 2 is a fragmentary perspective view of two sets of dry-type heat exchangers assembled in accordance with the teachings of this invention.
Figure 3:
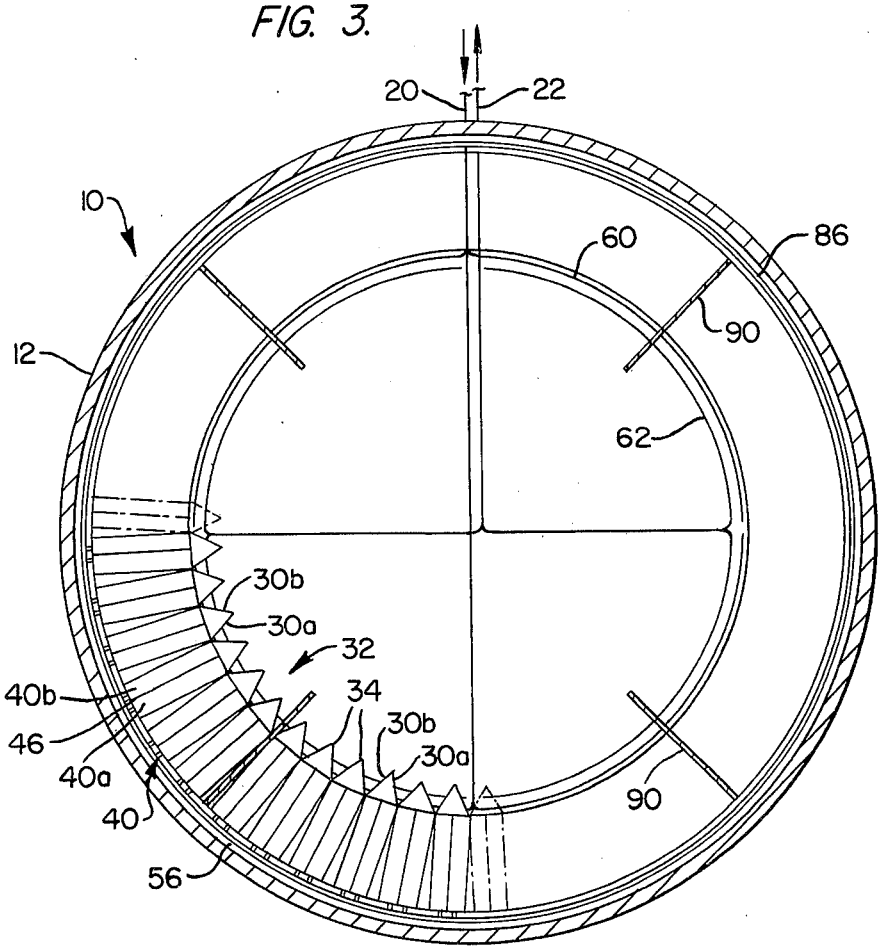
FIG. 3 is a sectional view of the tower shown in FIG. 1 at the level of the horizontal heat exchange units showing the arrangement of heat exchange units shown in FIG. 2.

Referring to FIGS. 1 through 5 of the drawings, 10 generally designates a chimney type natural draft cooling tower having a thin veil of concrete 12, forming the side wall thereof. The chimney is open at the top at 14 and is supported above the ground on a plurality of legs 16 and the space E between the lower edge of the veil and the ground defines the cooling air inlet 17 for the heat exchange tower. In FIG. 1 the letters H, D, and E designate the overall height of the tower, its diameter at the ground and the height of the annular cooling air inlet.

In the illustrated form the cooling tower, hot water, from condenser 18, is directed to the heat exchange units within the tower via conduit 20 and the cooled water is directed back to the condenser via conduit 22 and pump 24. The condenser 18 condenses and cools the exhaust from turbine 26 and the cooled liquid is pumped to the boiler not shown.

Erected on the ground, concentric to the opening 17, between a fifth and a third of the radius of the tower from the opening, is a unit of traditional dry-type heat exchange batteries generally designated 30 of finned tubes mounted vertically in pairs **30*a* and 30*b*, preferably V-shaped, so that the heat exchange surface, seen in a straight section, creates a toothed polygon 32, the teeth of which, 34, are directed toward the inside of the tower 10**.

Near the opening, inside the tower, a single circular row of columns 36 is erected. A unit of traditional batteries of dry-type heat exchangers generally designated 40 with finned tubes is placed horizontally or in slightly inclined fashion toward the bottom center of the tower, between the upper end 42 of the columns and the upper end 44 of the vertical batteries 30. Advantageously, heat exchangers 40 are mounted in pairs 40*a* and 40*b* in V-shaped configurations, the peaks 46 of which are directed upwards; each of the two units 30 and 40 are connected by means of brackets 48. Because of the radial arrangement of the batteries situated above the air entry, there remains between each pair of batteries 40*a* and 40*b* an open space 50 in the shape of a sector whose arc takes the shape of the periphery of the chimney. The spaces are sealed by plates 52 in known manner to force the air to cross the batteries; the annual space 54 between the wall 12 and the extremity of the horizontal batteries 40 is sealed off in analogous manner by plates 56. The same is done with triangular plates for the open space between the upper end 44 of the vertical bottom 30 and the inner end of the horizontal batteries 40.

Each exchanger unit 30*a*, 30*b*, 40*a* and 40*b* in the illustrated form of the invention comprises two beds designated A and B and each unit can be fed with water to be cooled separately or otherwise as to be more fully disclosed hereafter by means of the heater boxes in which the ends of the tubes of the heat exchange units are connected.

It will be noted that beds A are directly exposed to the cooling air while beds B receive air already partially heated in passing through beds A.

If the liquid to be cooled, especially the hot water from the condensor of the steam turbines of an electrical power plant, is to be circulated in series in each vertical battery 30 and the horizontal battery 40 to which it is affixed, and the cold air is first to meet the ascending current of hot water, the following mounting is carried out:

the hot water is brought into the tower through conduit 20, having a circular part 60 forming a hot water collector and provided with a circulation pump not shown in the drawings, the collector 60 is arranged at right angles to the vertical batteries 30;

next to this collector 60, a second circular collector 62 is installed and is connected to the conduit 22 to evacuate the cooled water;

the orifice 64 of the lower water box 66 of bed A of batteries 30 is connected to the hot water collector 60;

by means of a pipe 68, the orifice 70 of the upper water box 72 of bed A of batteries 30 is connected to orifice 74 of the water box 76 which is most inside the tower of bed A of batteries 40;

by means of a pipe 78, the orifice 80 of water box 76' most inside the tower of bed B of batteries 40 is connected to the orifice 82 of the upper water box 72 of bed B of batteries 30;

by suppressing the internal partition of water boxes 84 of batteries 40 which are most outside the tower, bed A and bed B of each horizontal battery are placed into communication with each other;

orifice 86 of lower water box 66 of bed B is connected to the cold water collector 62.

Since water boxes 84 of batteries 40 are common to both beds A and B, the water circulates automatically from the hot water entry towards the cold water evacuation piping using beds A and beds B successively, as soon as the siphon has been primed by a special low output pump but which is of greater manometric height than the circulation pump, not shown in the drawings.

Figure 4:
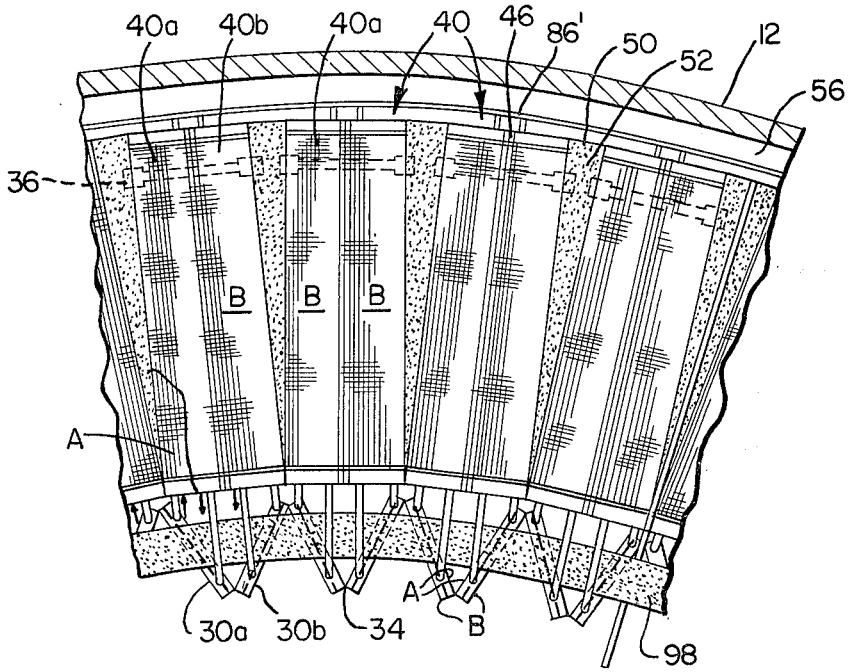
FIG. 4 is an enlarged fragmentary view of a portion of the assembly shown in FIG. 3.
Figure 5:
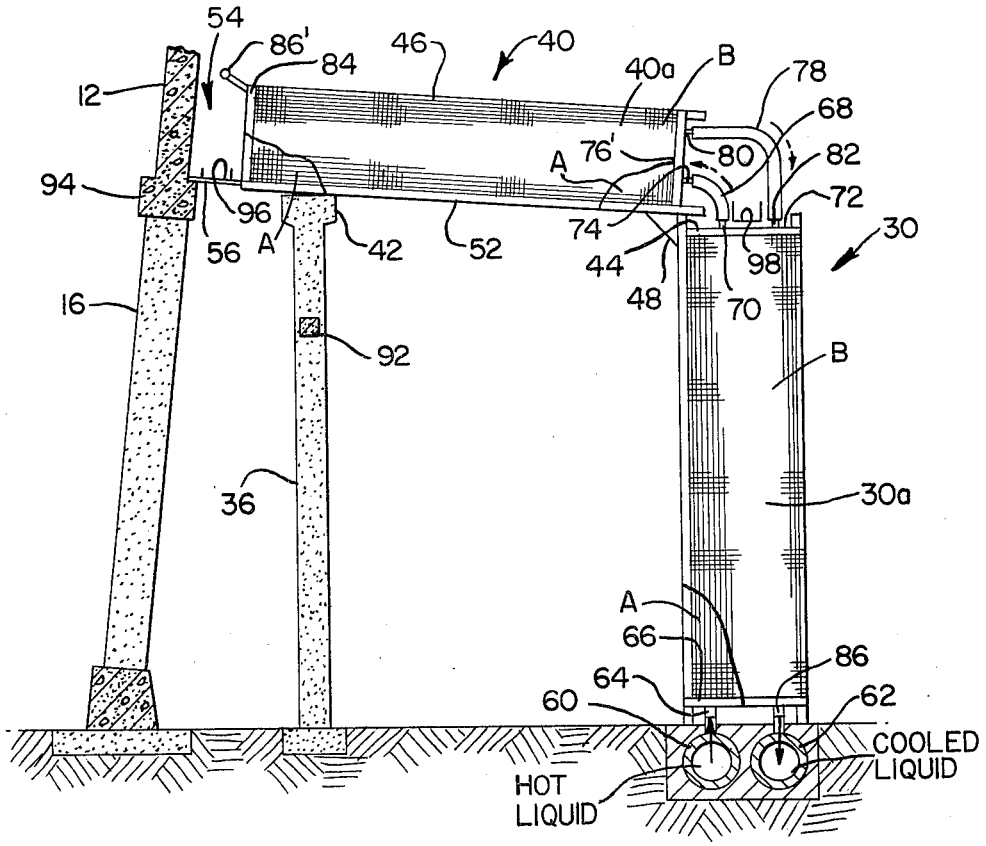
FIG. 5 is a fragmentary elevational view of the assembly shown in FIG. 4.

It is quite obvious that FIG. 4 shows only bed B of the two connected batteries and that, consequently, the water boxes of bed A and their orifices 64, 70, and 74 are really located in the background.

It should be noted that the equipment may also have pipings 86' (FIGS. 3, 4 and 5), small in diameter, connected to the highest point of each battery. Pipes 86 serve to evacuate the gas contained in the batteries at the time of the filling of the batteries and the introduction of the gas at the time of the emptying of the batteries. This gas is either atmospheric air, possibly dried, or an inert gas such as nitrogen and its pressure will generally be greater than atmospheric.

The mounting described is advantageous in that the heat exchanger tubes, exposed directly to the air, will not ice up when the weather is very cold, but it is quite obvious that the invention covers any other method of circulation in series and all the various means of circulation of liquid in parallel, i.e., mountings embodied by means of circulation of liquid in parallel, i.e., mountings embodied by means of collectors feeding separately the vertical batteries and the horizontal batteries and situated between the unit of vertical batteries and the unit of horizontal batteries and/or at the foot of the vertical batteries and on the periphery of the tower on the level of the horizontal batteries.

In the illustrated form of the invention, the tower has wind screens 90, analogous to those provided in so-called wet towers, to control the strong winds prevailing in storms, and to minimize the disturbances in the distribution of the air inside the tower.

The wind screens 90 consist of flat, vertical walls which extend from the periphery of the tower to the extremities of the batteries, arranged in this case in a cross to divide the cooling system into quarters.

The invention also covers any arrangement of battery other than that represented in the drawings as long as the heat exchange surface includes horizontal tubes (or tubes which are slightly inclined to facilitate the flow of liquid or for any other reason) placed above the air entry and tubes erected vertically back from the entry.

According to a variant of the invention, not shown in the drawings, the annular opening for air entry is replaced by a regular series of circular openings made in the wall of the tower right above the level of the ground; these openings may each be equipped with a blowing ventilator in order to increase the air flow of the chimney.

According to another form of execution of the invention, not shown in the drawings, the chimney may be equipped with vacuum ventilators, also for assisting with natural draft, placed inside the tower in a horizontal plane.

The description above reveals that the mounting of the batteries implies no particular support framework since the horizontal batteries are supported directly by the vertical batteries themselves and by a single circular row of poles braced by beams 92; the latter may, moreover, be replaced by the chimney lintel 94 itself, or by any type of framework.

96 and 98 denote two gangplanks which allow for the passage of those persons responsible for surveillance and maintenance of the system.

The mounting is, therefore, as simple as for dry towers in which the heat exchange surface is constituted exclusively by vertical batteries placed in the opening of the air intake.

Figure 6:
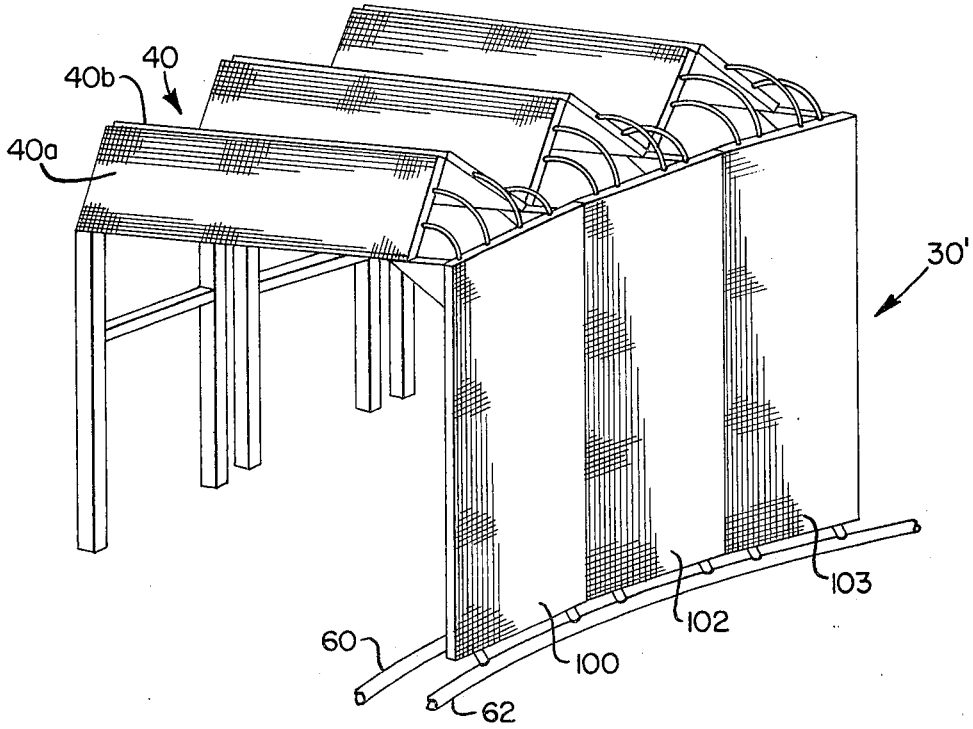
FIG. 6 is a view like FIG. 2 of a modified form of the present invention.

Referring now to FIG. 6 of the drawings, there is shown a modified form of the present invention wherein the vertical assembly of heat exchange batteries designated 30' comprise a plurality of units 100, 102, 103, etc., which are placed in side by side arrangement rather than in the angular form shown in FIGS. 2–5. In this form of the invention two concentric rows of such units may also be employed as previously discussed in reference to FIGS. 2–5.

Figure 7:
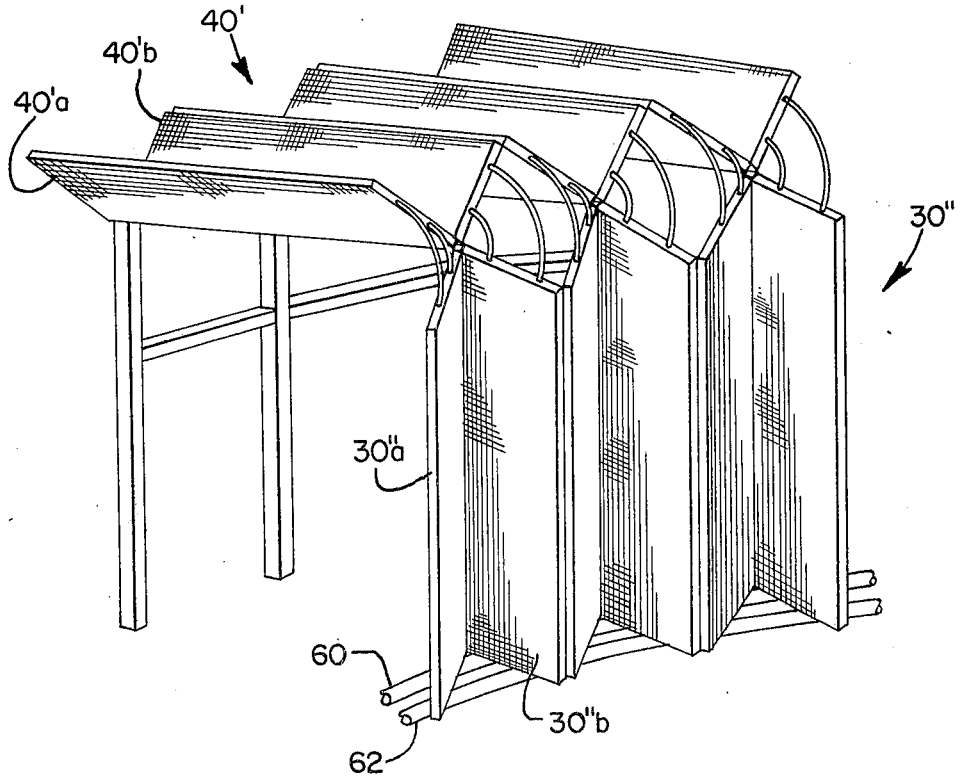
FIG. 7 is a view like FIG. 6 of still a further form of the present invention.
Figure 8:
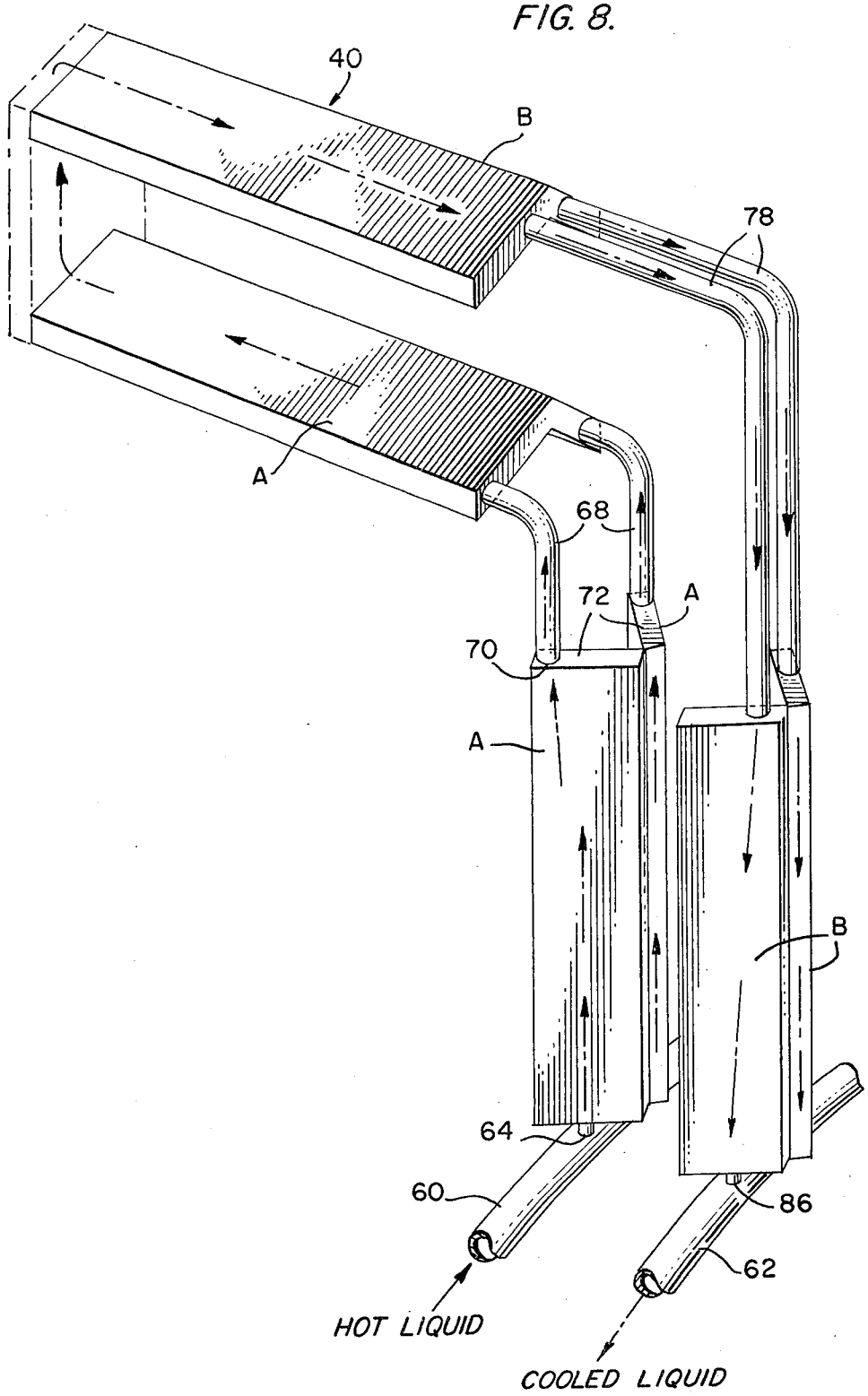
FIG. 8 is a diagrammatic exploded perspective view of one complete heat exchange battery of the type shown in FIGS. 2, 3, 4 and 5.

In FIG. 7, a further modified form of the present invention is illustrated wherein the horizontal or generally horizontal battery of heat exchange units generally designated 40', are arranged such that the apex of the V's forming the units point in a downward direction and each of the members of each group are designated 40'*a* and 40'*b*. Likewise, the vertically arranged group of batteries 30'' have the apexes of the pair of heat exchanged units 30''*a* and 30''*b* directed toward the periphery of the tower.

From the foregoing descriptions of preferred forms of the present invention, it will be seen that the aims and objects hereinbefore set forth are fully accomplished.

I claim:

1. An air cooled circular dry-type cooling tower assembly comprising a tower open at the upper end for the discharge of heated air, a peripheral air inlet about the base of the tower and a plurality of dry-type heat exchange assemblies mounted in said tower characterized in that the heat exchange assemblies comprises a first set of heat exchange units mounted within the tower in a vertically extending array on a circle concentric to the periphery of the tower, and a second set of heat exchange units mounted in a generally horizontal plane and extending in the annular air passage between from the tops of said first set of heat exchange units and the wall of the tower.

2. The air cooled dry-type cooling tower according to claim 1 further characterized in that the first set of heat exchange units is assembled in edge to edge relationship to thereby define, in section, a convex polygon.

3. The air cooled dry-type cooling tower according to claim 1 further characterized in that the first set of heat exchange units is assembled in pairs to form a plurality of batteries each in the shape of a V.

4. An air cooled dry-type cooling tower according to claim 3 further characterized by the fact that the apex of each pair of V-shaped units is directed towards the inside of the tower.

5. An air cooled dry-type cooling tower according to claim 3 further characterized by the fact that the apex of the pair of V-shaped units is directed toward the outside of the tower.

6. An air cooled dry-type cooling tower according to claim 1 further characterized by the fact that the second set of heat exchange units is mounted in pairs in a V-shaped configuration with the apexes of the V-shaped assemblies directed upwards.

7. An air cooled dry-type cooling tower according to claim 1 characterized by the fact that the second set of heat exchange units is arranged in the shape of V's with the point or apex thereof directed downwards.

8. An air cooled dry-type cooling tower as defined in claim 1 further characterized in that the first set of heat exchange units is arranged between one fifth and one third of the radius of the tower from the periphery thereof.

* * * * *